US009293852B2

(12) United States Patent
Glick et al.

(10) Patent No.: US 9,293,852 B2
(45) Date of Patent: Mar. 22, 2016

(54) ELECTRICAL TERMINAL ASSEMBLY

(71) Applicant: Lear Corporation, Southfield, MI (US)

(72) Inventors: Michael Glick, Farmington Hills, MI (US); Slobodan Pavlovic, Novi, MI (US); Tulasi Sadras-Ravindra, Canton, MI (US); Brantley Natter, Brighton, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 14/310,816

(22) Filed: Jun. 20, 2014

(65) Prior Publication Data

US 2015/0079859 A1 Mar. 19, 2015

Related U.S. Application Data

(60) Provisional application No. 61/837,835, filed on Jun. 21, 2013, provisional application No. 61/864,155, filed on Aug. 9, 2013.

(51) Int. Cl.

| | |
|---|---|
| ***H01R 4/48*** | (2006.01) |
| ***H01R 13/18*** | (2006.01) |
| ***H01R 43/20*** | (2006.01) |
| ***H01R 13/11*** | (2006.01) |
| *H01R 43/16* | (2006.01) |

(52) U.S. Cl.

CPC ..... *H01R 13/18* (2013.01); *H01R 13/11* (2013.01); *H01R 43/20* (2013.01); *H01R 43/16* (2013.01); *H01R 2201/26* (2013.01); *Y10T 29/49217* (2015.01)

(58) Field of Classification Search

CPC ..... H01R 13/18

USPC ..... 439/839, 842, 843, 846, 847, 852, 885, 439/752.5

See application file for complete search history.

(56) References Cited

U.S. PATENT DOCUMENTS

| | | | | |
|---|---|---|---|---|
| 2,945,206 | A * | 7/1960 | Hammell | 439/881 |
| 4,040,713 | A | 8/1977 | Könnemann | |
| 4,341,434 | A * | 7/1982 | Pfister | 439/839 |
| 4,540,234 | A | 9/1985 | Könnemann et al. | |

(Continued)

FOREIGN PATENT DOCUMENTS

| | | | |
|---|---|---|---|
| CN | 202094365 | U | 12/2011 |
| CN | 103996918 | A | 8/2014 |

(Continued)

OTHER PUBLICATIONS

PCT International Search Report and the Written Opinion, Application No. PCT/US2013/065900 filed Oct. 21, 2013, dated Feb. 12, 2014, [53-54478/Lear-51718].

*Primary Examiner* — Tho D Ta

(74) *Attorney, Agent, or Firm* — MacMillan, Sobanski & Todd, LLC

(57) ABSTRACT

An electrical terminal assembly includes a base and a spring member. The base defines an axis and includes a plurality of base beams deflectable toward the axis. The spring member has a main portion that is disposed over the base, and a plurality of spring beams that extend from the main portion. The spring beams bias the base beams toward the axis. The main portion of the spring member is made from a folded blank having a first edge that is permanently secured to a second edge such that the edges cannot be pulled apart from one another.

20 Claims, 7 Drawing Sheets

(56) References Cited

U.S. PATENT DOCUMENTS

| | | | | | |
|---|---|---|---|---|---|
| 4,540,235 | A | | 9/1985 | Lolic | |
| 4,583,812 | A | | 4/1986 | Gross, Jr. et al. | |
| 4,932,877 | A | * | 6/1990 | Zinn | 439/839 |
| 4,938,720 | A | * | 7/1990 | Romak | 439/839 |
| 5,007,865 | A | | 4/1991 | Jakobeit | |
| 5,064,379 | A | | 11/1991 | Ryll et al. | |
| 5,080,604 | A | | 1/1992 | Rider et al. | |
| 5,147,230 | A | | 9/1992 | Plyler et al. | |
| 5,334,058 | A | | 8/1994 | Hotea | |
| 5,338,229 | A | * | 8/1994 | Egenolf | 439/839 |
| 5,413,506 | A | | 5/1995 | Thompson | |
| 5,415,571 | A | | 5/1995 | Lutsch | |
| 5,437,566 | A | | 8/1995 | Zinn et al. | |
| 5,558,547 | A | | 9/1996 | Breitschaft et al. | |
| 5,573,434 | A | | 11/1996 | Ittah et al. | |
| 5,616,717 | A | | 4/1997 | Grozinger | |
| 5,654,972 | A | | 8/1997 | Kuroiwa et al. | |
| 5,664,972 | A | | 9/1997 | Zinn et al. | |
| 5,755,599 | A | | 5/1998 | Hotea | |
| 5,868,590 | A | * | 2/1999 | Dobbelaere | 439/839 |
| 5,876,253 | A | * | 3/1999 | Martucci et al. | 439/748 |
| 5,941,740 | A | | 8/1999 | Neuer et al. | |
| 5,975,964 | A | | 11/1999 | Seko et al. | |
| 5,993,253 | A | | 11/1999 | Sai | |
| 6,186,840 | B1 | * | 2/2001 | Geltsch et al. | 439/843 |
| 6,224,428 | B1 | | 5/2001 | Chen et al. | |
| 6,402,571 | B1 | | 6/2002 | Muller et al. | |
| 6,475,040 | B1 | | 11/2002 | Myer et al. | |
| 7,252,559 | B1 | | 8/2007 | Morello et al. | |
| 7,278,891 | B2 | | 10/2007 | Cvasa et al. | |
| 7,556,542 | B2 | | 7/2009 | Lischeck et al. | |
| 7,578,694 | B2 | | 8/2009 | Takahashi et al. | |
| 7,766,706 | B2 | | 8/2010 | Kawamura et al. | |
| 7,892,050 | B2 | | 2/2011 | Pavlovic et al. | |
| 7,988,481 | B2 | | 8/2011 | Bethurum et al. | |
| 8,043,131 | B2 | * | 10/2011 | Ngo | 439/877 |
| 8,057,261 | B1 | | 11/2011 | DeSio et al. | |
| 8,182,299 | B2 | * | 5/2012 | Schrader | 439/857 |
| 8,282,426 | B2 | | 10/2012 | Zweigle | |
| 8,339,235 | B2 | | 12/2012 | Beckert et al. | |
| 8,366,497 | B2 | | 2/2013 | Glick et al. | |
| 8,475,220 | B2 | | 7/2013 | Glick et al. | |
| 8,678,867 | B2 | | 3/2014 | Glick et al. | |
| 8,858,274 | B2 | * | 10/2014 | Jakoplic et al. | 439/877 |
| 2001/0019924 | A1 | | 9/2001 | Heimueller | |
| 2003/0067242 | A1 | | 4/2003 | Konishi et al. | |
| 2006/0040555 | A1 | | 2/2006 | Chen et al. | |
| 2010/0311280 | A1 | | 12/2010 | Tin et al. | |
| 2012/0129407 | A1 | | 5/2012 | Glick et al. | |
| 2013/0045630 | A1 | | 2/2013 | Natter | |
| 2013/0090009 | A1 | | 4/2013 | Zhao | |
| 2013/0130530 | A1 | | 5/2013 | Casses et al. | |
| 2013/0330968 | A1 | | 12/2013 | Duan | |
| 2014/0235113 | A1 | | 8/2014 | Glick et al. | |

FOREIGN PATENT DOCUMENTS

| | | | |
|---|---|---|---|
| DE | 10019241 | A1 | 10/2001 |
| DE | 69934065 | T2 | 6/2007 |
| DE | 10021972 | B4 | 3/2009 |
| DE | 19961544 | B4 | 3/2009 |
| EP | 0282624 | A2 | 9/1988 |
| GB | 2323221 | A | 9/1998 |
| JP | 10125378 | A | 5/1998 |
| JP | 2011238399 | A | 11/2011 |
| WO | 89/05531 | A1 | 6/1989 |
| WO | 2014/063142 | A1 | 4/2014 |

* cited by examiner

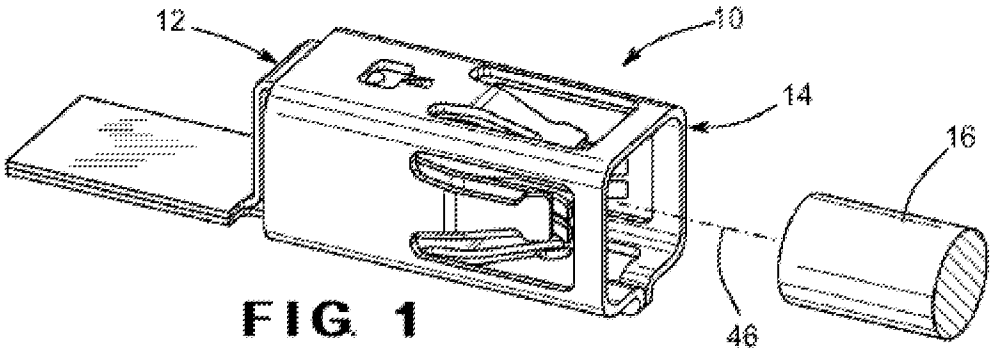
FIG. 1
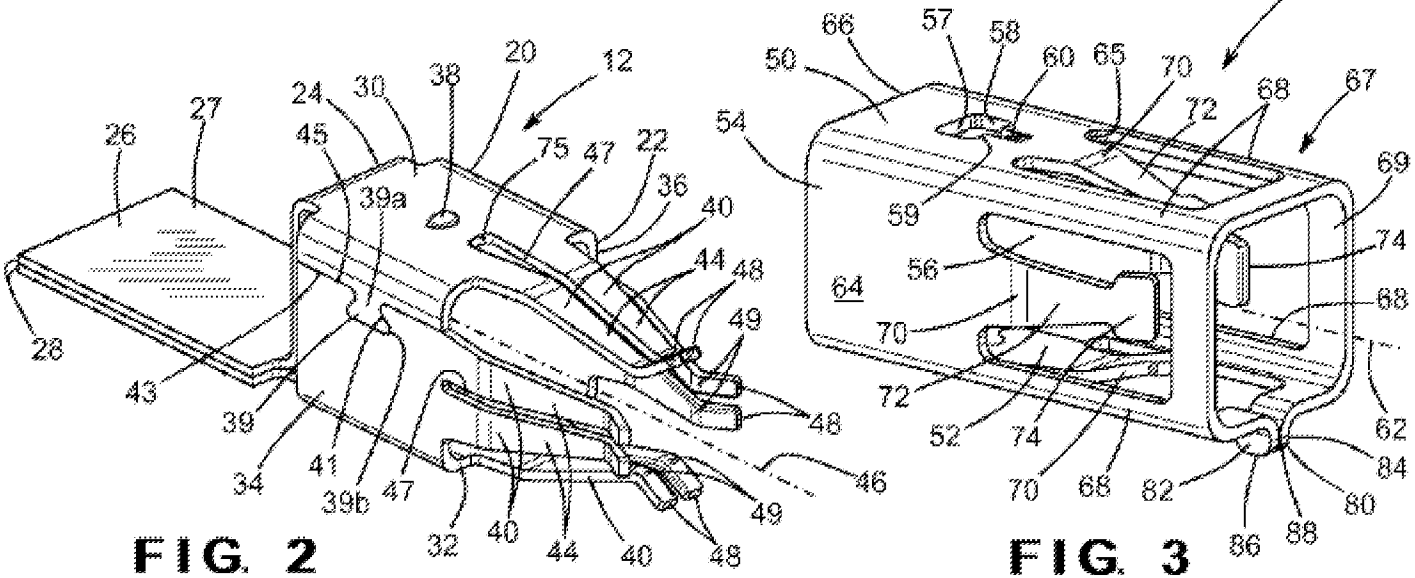
FIG. 2
FIG. 3

ELECTRICAL TERMINAL ASSEMBLY

CROSS-REFERENCE TO RELATED APPLICATIONS

This application claims the benefit of U.S. Provisional Application No. 61/837,835, filed Jun. 21, 2013, and U.S. Provisional Application No. 61/864,155, filed Aug. 9, 2013, the disclosures of which are incorporated herein by reference.

BACKGROUND OF THE INVENTION

This invention relates in general to electrical terminals such as for use in high power vehicle electrical connectors. Electrical connectors commonly include a body having a nonconductive housing encasing a conductive set of female electrical terminals. The set of female terminals are each connected to a respective end of a wire connector or fuse element retained in the housing for completing an electrical circuit. The female terminals are inserted over a set of male blade terminals. For example, the male blade terminals may be housed in another connector housing, such as for example, a power distribution box. The female terminals are typically designed with a spring-type feature to maintain a strong electrical contact with the outer surface of the male terminal blades.

Copper has good electrical conductivity properties, and has been a preferred material for terminals even though it is relatively expensive. However, copper is susceptible to relaxation (i.e., loss of spring force) as the temperature of the copper material increases. Since the temperature of the terminals increases as the current drawn in the electrical circuit increases, copper terminals have a reduced ability to maintain strong clamping force onto the male terminal blades. Relaxation of the female terminals may decrease the overall contact area with the male blades, resulting in reduced electrical conductivity, increased resistance, and a further increase in temperature.

It is desirable to keep the overall size of an electrical distribution box or other connectors as small as possible while still providing the necessary current-carrying capacity. In some situations, the spring force cannot be further increased by simply making the terminals thicker or wider. When copper is used, the size limitations may make the desired spring force unattainable.

During handling and transportation of the female connectors after manufacture, the copper spring contacts of the female terminals are susceptible to being bent and damaged. Therefore, it is desirable to provide a female electrical terminal that is durable while still having desirable spring force characteristics.

SUMMARY OF THE INVENTION

This invention relates to electrical terminals and, in particular, to a two-piece electrical terminal having a base and a spring member. The base defines an axis and includes a plurality of base beams deflectable toward the axis. The spring member has a main portion that is disposed over the base, and a plurality of spring beams that extend from the main portion. The spring beams bias the base beams toward the axis. The main portion of the spring member is made from a folded blank having a first edge that is permanently secured to a second edge such that the edges cannot be pulled apart from one another.

The invention also relates to an electrical terminal assembly including a main portion made from a folded flat blank having a first edge that is secured to a second edge by a locking feature integrally formed in the first and second edges. The locking feature is defined by a recess formed in the second edge and a flap adjacent to the recess that is formed outwardly relative to a surface of the blank. The locking feature is further defined by a tab extending from the first edge. The tab is formed over the flap so as to trap the flap between the tab and a portion of the blank adjacent to the second edge.

Various aspects of this invention will become apparent to those skilled in the art from the following detailed description of the preferred embodiments, when read in light of the accompanying drawings.

BRIEF DESCRIPTION OF THE DRAWINGS

FIG. 1 is a perspective view of an electrical terminal assembly in a fully assembled position.

FIG. 2 is a perspective view of the base of the electrical terminal assembly of FIG. 1.

FIG. 3 is a perspective view of the spring member of the electrical terminal assembly of FIG. 1.

DETAILED DESCRIPTION OF THE PREFERRED EMBODIMENTS

Figure 4:
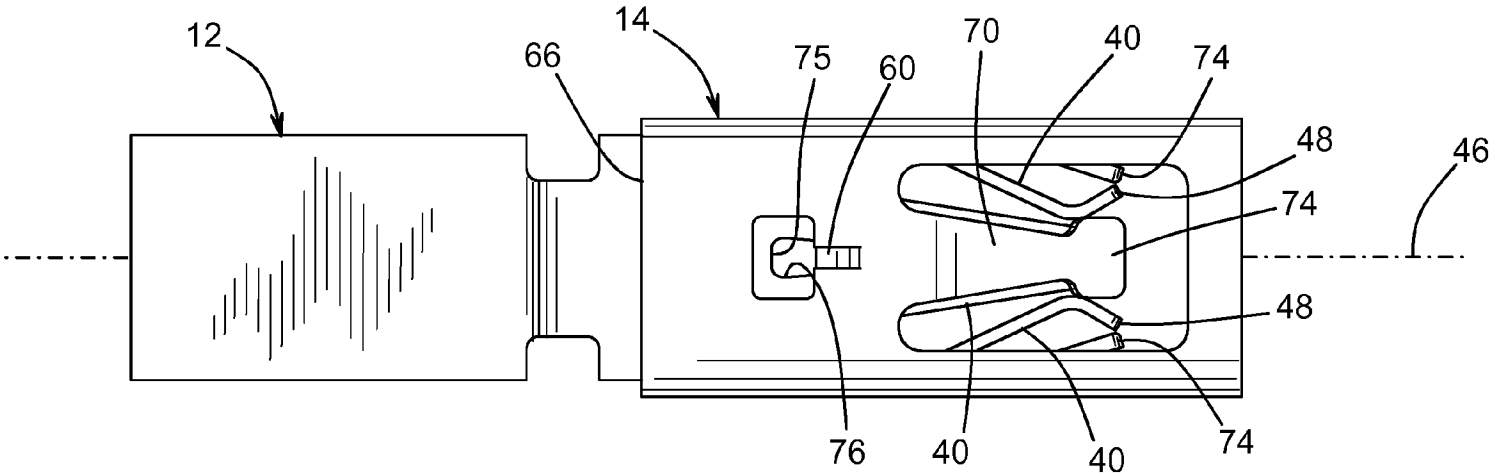
FIG. 4 is a top plan view of the electrical terminal assembly of FIG. 1 shown in a partially assembled position.

Referring now to the drawings, there is illustrated in FIG. 1 an electrical terminal assembly, indicated generally at 10. The electrical terminal assembly 10 includes a base, indicated generally at 12, and a spring member, indicated generally at 14. In an assembled condition of the electrical terminal assembly 10, the base 12 is inserted within the spring member 14, as shown in FIG. 1. In the embodiment shown, the electrical terminal assembly 10 has a rectangular or box-shape such that both the base 12 and the spring member 14 have four sides, as will be described below. The widths of the each of the sides may be equal or unequal. It should be understood that the base 12 and the spring member 14 may be shaped other than a four sided box, as shown in the figures. For example, the base 12 and the spring member 14 may have three sides, six sides, or any suitable number of sides. Alternatively, the base 12 and the spring member 14 may be cylindrical in shape. In a preferred embodiment, the base 12 and the spring member 14 are generally symmetrical about an axis 46. As will be described below, the base 12 is inserted within the spring member 14 along the axis 46 during assembly of the electrical terminal assembly 10.

The electrical terminal assembly 10 is used to make an electrical connection with an electrical connector, such as a pin 16, shown in FIG. 1. Although the pin 16 is shown having a cylindrical shape, the electrical terminal assembly 10 may also engage with a pin having a non-cylindrical shape. For example, the pin may have a generally rectangular cross-section corresponding to the four-sided electrical terminal assembly 10. The electrical terminal assembly 10 may be inserted, molded into, or otherwise secured to a plastic body of a connector (not shown). The connector may include multiple electrical terminal assemblies 10 mounted therein. The electrical terminal assembly 10 is well suited for use in high power distribution boxes used in automotive vehicles.

The base 12 may be formed from a single metallic blank which is stamped and formed into the configuration shown in FIG. 2. Similarly, the spring member 14 may also be formed from a single metallic blank which is stamped and formed into the configuration shown in FIG. 3. The base 12 is preferably made of an electrically conductive material such as a copper alloy or an aluminum alloy. Aluminum has an advantage over copper in automotive applications since it is lighter and less expensive than copper. As will be explained below, the spring member 14 generally is provided to assist in forcing or pushing electrical contact engagement surfaces of the base 12 against the pin 16. Therefore, the spring member 14 is preferably made of a material, such as stainless steel, having a relatively high yield strength or spring-like quality. Preferably, the material of the spring member 14 can retain its spring like qualities over a relatively large temperature range, which can act on the electrical terminal assembly 10 in high power applications, such as within electric or hybrid vehicles.

As shown in FIG. 2, the base 12 generally includes a box-shaped central or main portion 20 having a front end 22 and a rear end 24. Extending outwardly from the rear end 24 is a plate 26. The plate 26 is used to connect with an end of a wire conductor (not shown). The end of the wire conductor may be welded, soldered, or otherwise connected to a flat surface 27 of the plate 26 to provide electrical communication between the wire conductor and the base 12. The plate 26 can have any shape or configuration suitable for connecting to the end of the wire. As shown in the embodiment of FIG. 2, the plate 26 is formed from a pair of relatively thin strip portions 28 of the blank folded against one another. The plate 26 may extend outwardly from the main portion 20 such that it is co-planar with one of the sides of the main portion 20, as shown in the embodiment illustrated in FIG. 2, or it may be configured in other suitable arrangements.

The box-shaped main portion 20 includes an upper wall 30, a bottom wall 32, a first side wall 34, and a second side wall 36. The walls 30, 32, 34, and 36 are generally oriented at 90 degrees relatively to adjacent ones. The upper wall 30 includes a protuberance or a tab 38 extending slightly upward from an outer surface of the upper wall 30. In the embodiment shown, the tab 38 is formed by creating a lateral slit into the upper wall 30 and pushing a slightly deformed portion adjacent the slit upwardly in a stamping or forming operation. As will be explained below, the tab 38 is part of a first securing feature for securing the spring member 14 to the base 12.

As stated above, the base 12 may be formed from a single stamped sheet or blank of material folded into the configuration shown in FIG. 2. As shown in FIG. 2, the main portion 20 may be formed by forming the four walls 30, 32, 34, and 36 from a blank and connecting opposite edges 43 and 45 of the blank together. The edges 43 and 45 may include integrally formed locking features to connect the edges 43 and 45 together in a non-overlapping manner. For example, the base 12 may include a dovetail tab 39 extending from the first edge 43 of the blank which interlocks with a correspondingly shaped dovetail recess 41 formed in the second edge 45 of the blank. Of course, the edges 43 and 45 of the blank may also be welded, adhered, or otherwise attached to one another to form the base 12. However, the use of a dovetail configuration provides a mechanical interlock such that the first edge 43 may not be pulled away from the second edge 45. The dovetail tab 39 has a flared enlarged portion 39*b* that is connected to the first edge 43 by a reduced necked down portion 39*a*.

Extending from the front end 22 of the main portion 20 is a plurality of elongated base beams 40 which engage the outer cylindrical surface of the pin 16 to complete an electrical connection between the base 12 and the pin 16. In the embodiment shown, each of the base beams 40 includes a slot 47 formed therein to define a pair of adjacent base beams 40. A pair of base beams 40 extends from each wall 30, 32, 34, and 36, thereby providing four pairs of base beams 40. Each of the base beams 40 includes an angled portion 44 extending inwardly relative to the axis 46. Note that the pin 16 is inserted into the base 12 along the axis 46, as shown in FIG. 1. Each of the base beams 40 also includes a tip portion 48 which is curved or bent slightly outwardly from the end of the respective angled portions 44. The connection between each of the angled portions 44 and the associated one of the tip portions 48 defines a contact engagement surface 49 for contacting the outer surface of the pin 16. Note that the use of pairs of base beams 40, compared to a single base beam having a single contact engagement surface, provides a greater number of contact points with the outer cylindrical surface of the pin 16.a11

Figure 6:
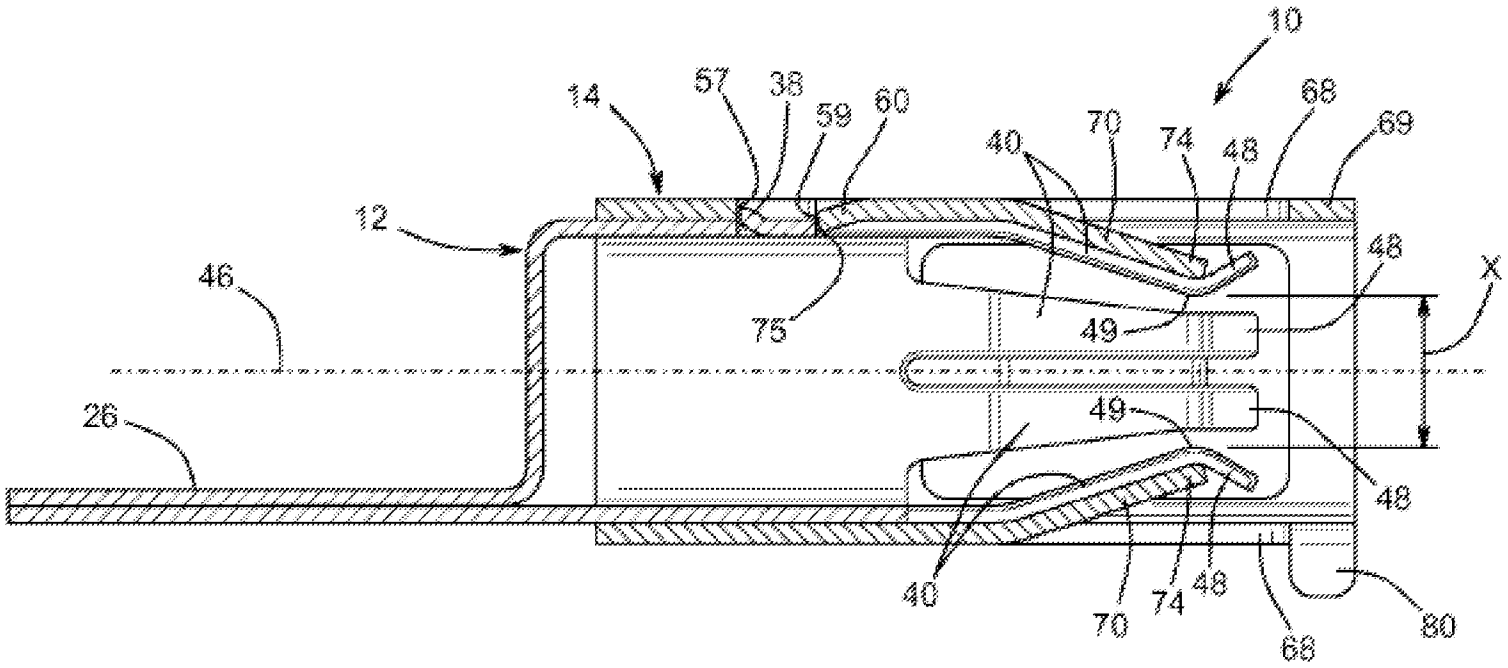
FIG. 6 is a cross-sectional view taken along line 6-6 of FIG. 5 illustrating the electrical terminal assembly in a fully assembled position.

Referring now to FIG. 3, the spring member 14 has a box-like shape and includes an upper wall 50, a bottom wall 52, a first side wall 54, and a second side wall 56. The walls 50, 52, 54, and 56 are generally oriented at 90 degrees relatively to adjacent ones. The upper wall 50 includes an opening 58 formed therein. As best shown in FIG. 6, adjacent to a front edge 59 of the opening 58 is a resilient finger 60 extending at an angle radially inwardly toward an axis 62 defined by the spring member 14. The finger 60 is also illustrated in cross-section in FIG. 11, as will be discussed below. Note that the axis 62 defined by the box-shaped spring member 14 is co-axial with the axis 46 of the base 12 when the base 12 and the spring member 14 are connected together to form the electrical terminal assembly 10, as shown in FIG. 1. As will be explained below, the opening 58 and the finger 60 of the spring member 14 cooperate to provide a second securing feature for securing the spring member 14 relative to the base 12.

Figure 12:
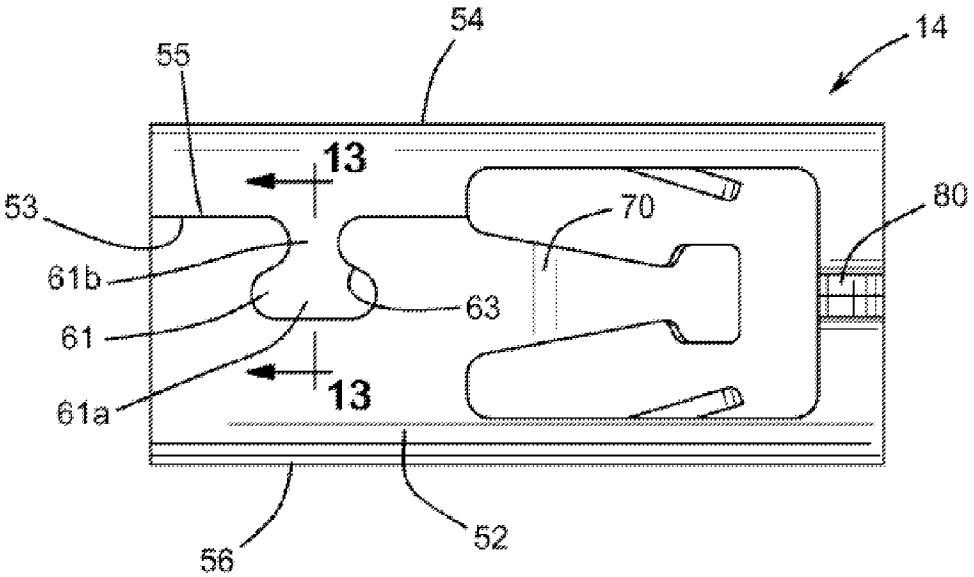
FIG. 12 is a bottom view of the spring member of FIG. 3 illustrating a dovetail interlock.
Figure 13:
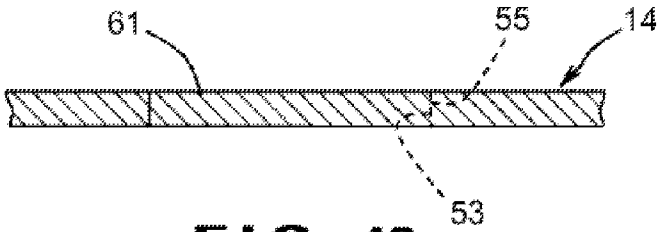
FIG. 13 is a sectional view taken along line 13-13 of FIG. 12 illustrating the lack of an overlap.

Similar to the base 12, the spring member 14 may be formed by stamping and bending a blank into the configuration of the spring member 14. The spring member 14 may be formed by forming the four walls 50, 52, 54, and 56 from a blank and connecting opposite edges 53 and 55 of the blank, as shown in FIG. 12 (bottom view of the spring member 14). The edges 53 and 55 may include integrally formed lock features to connect the edges 53 and 55 together in a non-overlapping manner. For example, spring member 14 may include a dovetail tab 61 extending from the edge 53 of the blank which interlocks with a correspondingly shaped dovetail recess 63 formed in the edge 55 of the blank. Of course, the edges 53 and 55 of the blank may also be welded, adhered, or otherwise attached to one another to form the base 12. However, the use of a dovetail configuration provides a mechanical interlock such that the edge 53 may not be pulled away from the edge 55. The dovetail tab 61 has a flared enlarged portion 61*a* that is connected to the edge 53 by a reduced necked down portion 61*b*. The cross-sectional view of FIG. 13 illustrates that the dovetail 61 and the recess 63 provide a locking feature that does not have any overlapping portions such that the bottom wall 52 is relatively flat. The presence of a flat wall is ideal for sliding the electrical terminal assembly 10 into a bore of a connector housing (not shown) compared to some conventionally manufactured electrical terminals have raised overlapping regions of their locking features.

The walls 50, 52, 54, and 56 of the spring member 14 define a box-shaped main portion 64 having a front end 65 and a rear end 66. Extending from the front end 65 of the main portion 64 is an extension or framework, indicated generally at 67, that provides protection for the base beams 40 of the base 12. The framework 67 is defined by four legs 68 extending from the front end 65 of the main portion 64. In the embodiment shown, the four legs 68 extend from corners of the box-shaped main portion 64. The forwardly extending legs 68 are integrally attached to a four-sided band 69 generally disposed about the axis 62. The presence of the framework 67 provides structural rigidity for the spring member 14 as well as providing cage like protection for the base beams 40 of the base 12. During shipping and handling of the assembled electrical terminal assembly 10, it is desirable to prevent the base beams 40 from bending out of proper position. The relatively strong stainless steel framework 67 helps provide such protection. The band 69 also functions as a guide during insertion of the pin 16 if the pin is misaligned with the base beams 40. It should be understood that the spring member 14 may be configured without the framework 67, thereby reducing the weight of the spring member 14.

Each of the walls 50, 52, 54, and 56 includes an elongated spring beam 70 extending forwardly from the front end 65 of the main portion 64. The spring beams 70 engage the base beams 40 helping to force the contact engagement surfaces 49 against the outer cylindrical surface of the pin 16. In the embodiment shown, a single spring beam 70 extends from each wall, thereby providing four spring beams 70. Each of the spring beams 70 includes an angled portion 72 extending radially inwardly towards the axis 62. Each of the spring beams 70 also includes a tip portion 74 which flares out laterally such that the width of the tip portion 74 is sufficient to engage the pair of respective base beams 40.

The spring member 14 may include a polarizing key feature such that the electrical terminal assembly 10 can be inserted into a connector housing (not shown) in only one desired orientation. This helps direct the wires (not shown) extending from the connector housing in a desired orientation. For example, the bottom wall 52, or any of the other walls 50, 54, and 56, may include a radially outwardly extending ear 80. The ear 80 may provide an interference such that the electrical terminal assembly 10 can only be inserted into the connector housing in a desired orientation. For example, the connector housing may include a four sided hole or bore sized to receive the electrical terminal assembly 10. The connector housing may include a slot formed in one of the four sides for receiving the ear 80 such that the electrical terminal assembly 10 can only be inserted in one of the four positions. The ear 80 may also be used as a stop member for insertion of the electrical terminal assembly 10 within the bore of the housing by a limited distance. In the illustrated embodiment shown in FIG. 3, the ear 80 is formed from bent portions 82 and 84 adjacent edges 86 and 88 of the blank. Location of the polarizing ear 80 at the edges 86 and 88 provides a suitable structure for forming the polarizing key feature.

Figure 5:
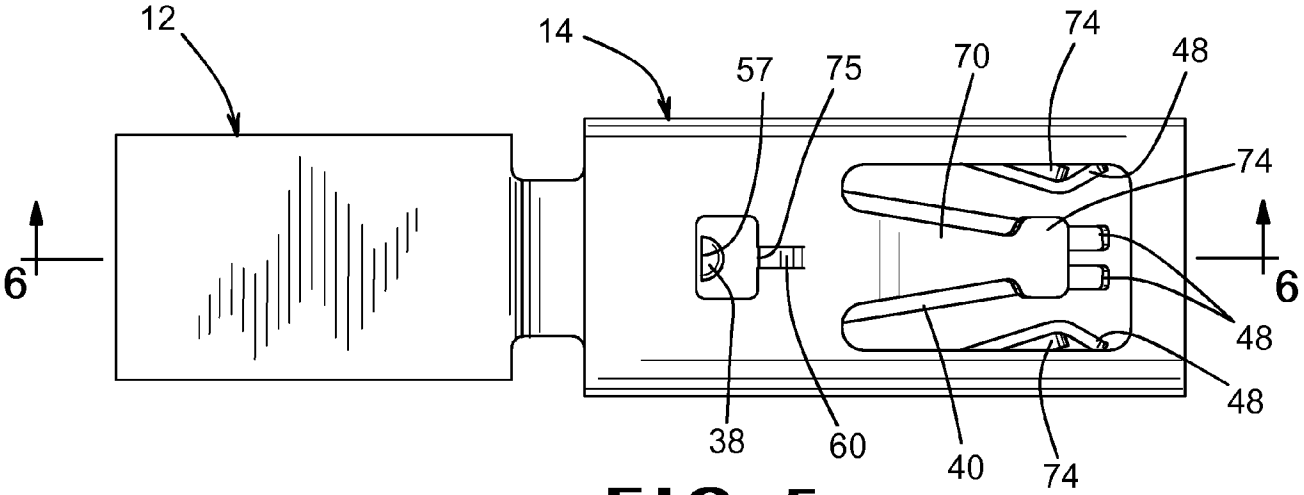
FIG. 5 is a top plan view of the electrical terminal assembly of FIG. 1 shown in a fully assembled position.

FIGS. 4 and 5 illustrate a first method of assembly of the spring member 14 onto the base 12 to form the electrical terminal assembly 10. In this first method of assembly, no tools are used to pre-flex the base beams 40 or the spring beams 70. To assemble, base 12 is inserted into the spring member 14 such that the rear end 66 of the spring member 14 is slipped over the front end 22 (hidden in FIG. 4) of the base 12, as shown in FIG. 4. FIG. 4 illustrates the electrical terminal assembly 10 at a partially assembled position in which the spring beams 70 have engaged with the base beams 40 and started deflection of the base beams 40 radially inwardly towards the axis 46. Upon initial contact between the spring beams 70 and the base beams 40, the tip portions 74 of the spring beams 70 will engage with the tip portions 48 of the respective base beams 40. Continued movement of the spring member 14 relative to the base 12 will cause the spring beams 70 to deflect the base beams 40 radially inwardly, as shown in FIG. 4. Note that the spring beams 70 may also deflect slightly radially outwardly as well but generally not as much due to the higher yield strength of the material of the spring member 14 compared to the material of the base 12. Further continued movement of the spring member 14 over the base 12 will cause the base beams 40 to move back radially outwardly due to the angled orientation of the tip portions 74 of the spring beams 70 moving past the tip portions 48 of the base beams 40, as shown in FIGS. 5 and 6. FIGS. 5 and 6 illustrate the electrical terminal assembly at its fully assembled position.

When the electrical terminal assembly 10 is in its fully assembled position, as shown in FIGS. 5 and 6, optional first and second securing features of the electrical terminal assembly 10 also prevent axial movement of the base 12 relative to the spring member 14. More specifically, as best shown in FIG. 6, the tab 38 of the upper wall 30 of the base 12 is disposed in the opening 58 of the upper wall 50 of the spring member 14 to provide the first securing feature. An edge of the tab 38 engages with an edge 57 of the opening 58 to prevent the spring member from moving in a rightward direction, as viewing FIG. 6, relative to the base 12, to provide the second securing feature. Note that during insertion of the base 12 into the spring member 14, the base 12 and/or spring member 14 may flex to accommodate the tab 38 sliding along a lower surface of the upper wall 30 of the base 12. The tab 38 will then snap upwardly into the opening 58 when positioned therein. To prevent movement in the other direction, the finger 60 of the spring member 14 engages with an edge 75 of the slot 47 formed between the pair of base beams 40 on the upper wall 30 of the base 12.

As shown in FIG. 6, the distance X between the contact engagement surfaces 49 of opposed tip portions 48 of the base beams 40 is preferably less than the width of diameter of the pin 16. When the pin 16 is inserted into the electrical terminal assembly 10 during use thereof, the tip portions 48 of the base beams 40 and the tip portions 74 of the spring beams will deflect radially outwardly to accommodate the insertion of the pin 16. This deflection biases the contact engagement surfaces 49 of the base beams against the outer surface of the pin 16.

Figure 7:
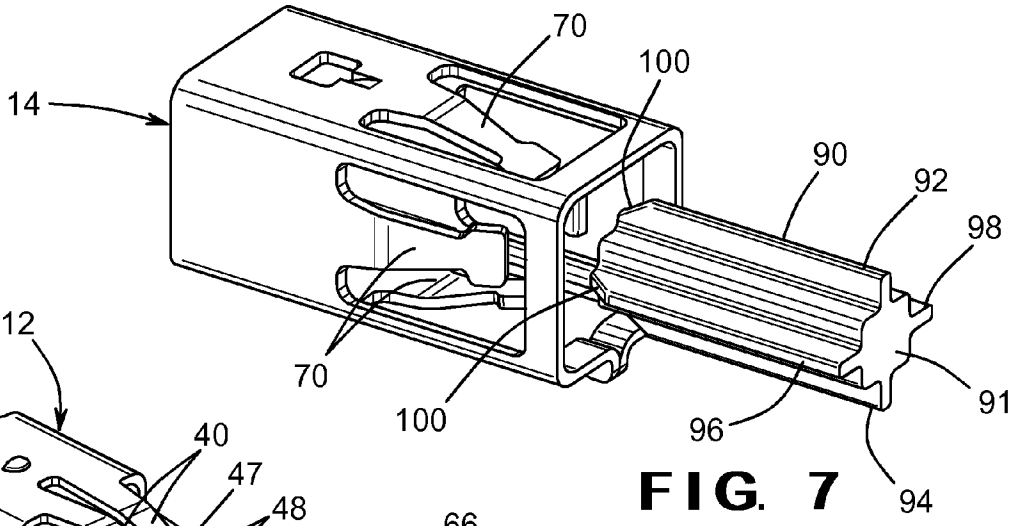
FIG. 7 is a perspective view of the spring member having an arbor shown at a pre-position for insertion into the spring member prior to an assembly operation.
Figure 8:
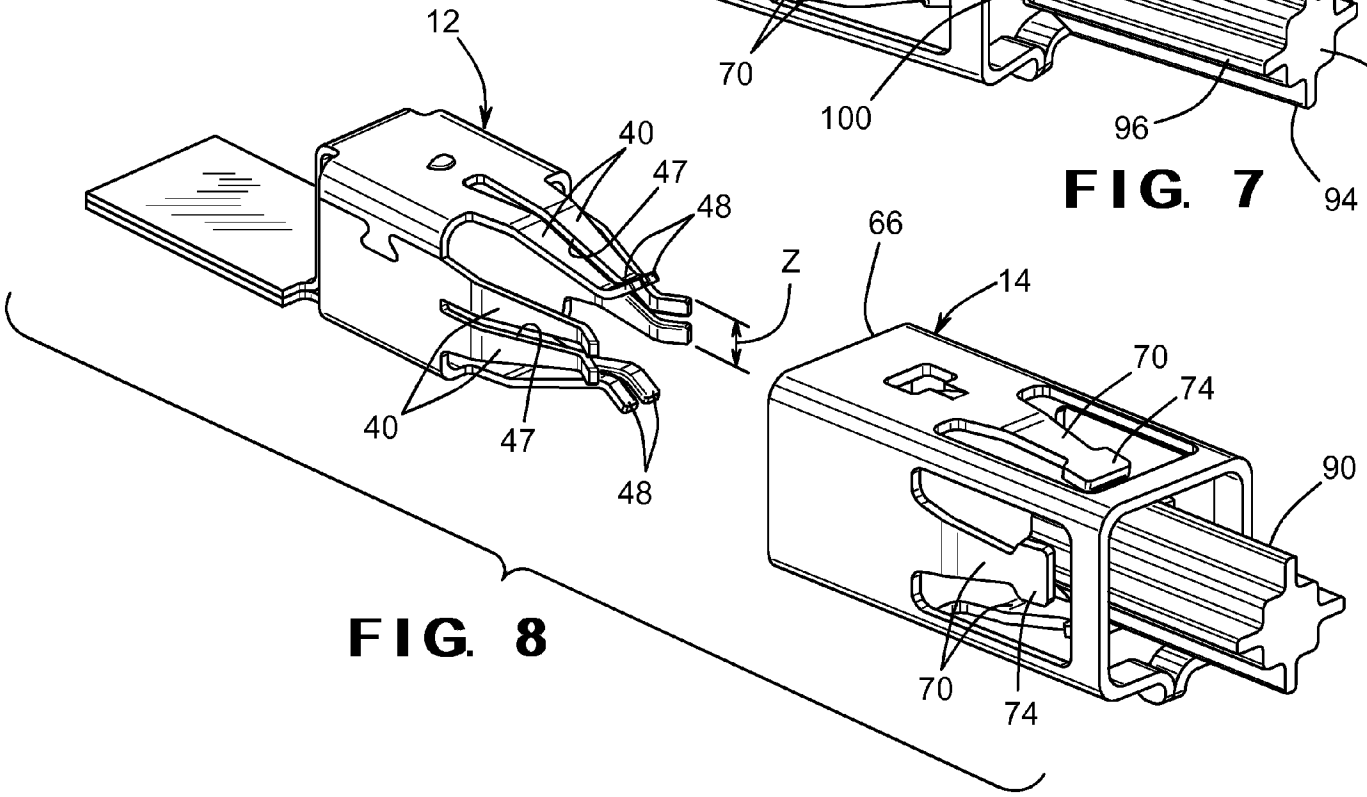
FIG. 8 is a perspective view illustrating the insertion of the arbor into the spring member, and wherein the base is shown at a pre-position relative to the spring member.
Figure 9:
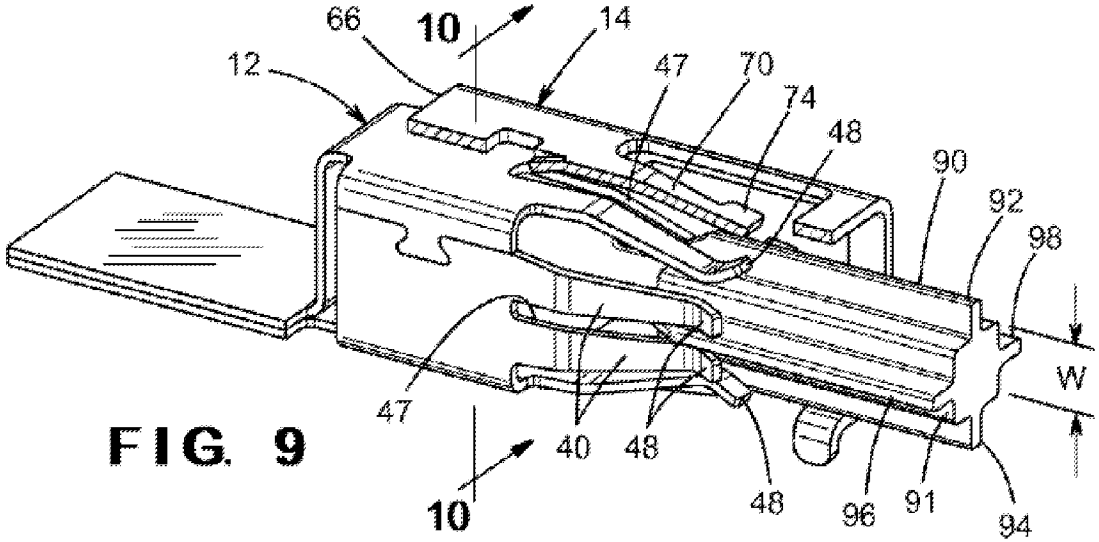
FIG. 9 is a partial cross-sectional perspective view illustrating the base being inserted almost fully into the spring member while the arbor is in the same insertion position shown in FIG. 8.

FIGS. 7 through 9 illustrate a second method of assembly of the spring member 14 onto the base 12. In this second method of assembly, a tool, such as an elongated arbor 90, is used to first flex the spring beams 70 radially outwardly prior to insertion of the spring member 14 onto the base 12. In the illustrated embodiment, the arbor 90 has a generally cross shaped cross-section. The arbor 90 includes an elongated central body 91 having a generally rectangular cross-section. The arbor 90 further includes an upper rib 92, a lower rib 94, and a pair of side ribs 96 and 98 that extend radially outwardly from the central body 91, as shown in FIG. 7. End portions of the ribs 92, 94, 96, and 98 may include ramped surfaces 100 which initially engage with the tip portions 74 of the spring beams 70 during insertion of the arbor 90.

During the second method of assembly, the arbor 90 is first moved from a non-engaged position, as shown in FIG. 7, to an engaged position, as shown FIG. 8, such that the arbor 90 is inserted into the spring member 14. During initial insertion, the tip portions 74 of the spring beams 70 slide along the four ramped surfaces 100 of the respective ribs 92, 94, 96, and 98 such that the tip portions 74 are deflected radially outwardly until the tip portions 74 are positioned on the elongated axial surfaces of the ribs 92, 94, 96, and 98 to their fully deflected position, as shown in FIG. 8. The base 12 is then inserted into the rear end 66 of the spring member 14, as shown in FIG. 9. During insertion, the tip portions 48 of the base beams 40 may slide along portions of the central body 91 of the arbor 90, as shown in FIG. 9. The width W of the central body 91 may be equal to or less than the distance between contact engagement surfaces 49 of opposed tip portions 48 such that the base beams 40 are not deflected during insertion of the base 12 within the spring member 14. Of course, the arbor 90 may be sized such that a slight deflection of the base beams 40 may occur.

During insertion of the base 12 onto the arbor 90, as show in FIG. 9, the ribs 92, 94, 96, and 98 extend into the respective slots 47 between the corresponding pair of base beams 40 of the base 12. Thus, the presence of the slots 47 permits the ribs 92, 94, 96, and 98 of arbor 90 to engage with and extend the spring beams 70 radially outwardly without engaging with and extending the base beams 40 outwardly.

Figure 11:
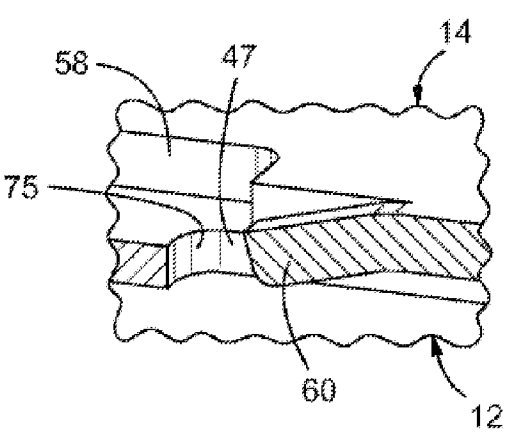
FIG. 11 is an enlarged partial cross-sectional perspective view of a portion of the electrical terminal assembly illustrating a second securing feature prior to being disposed in the fully locked position.
Figure 10:
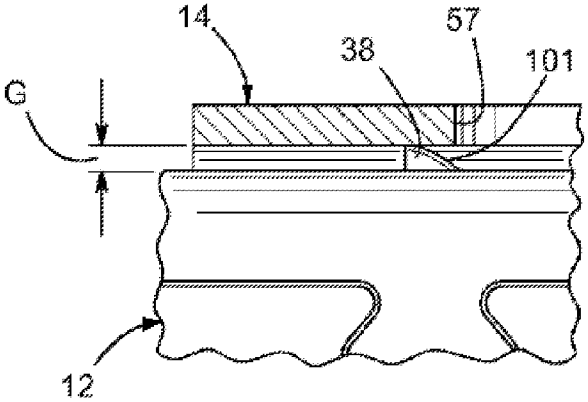
FIG. 10 is an enlarged partial cross-sectional elevational view taken along line 10-10 of FIG. 9 illustrating a first securing feature of the electrical terminal assembly prior to being disposed in the fully locked position.

FIG. 9 illustrates the electrical terminal assembly 10 in a not yet fully assembled position such that the securing features have not yet engaged with one another. As shown in FIG. 10, the upper wall 50 of the spring member 14 may be spaced from the upper wall 30 of the base 12 by a distance or gap G. The gap G may be significantly reduced once the electrical terminal assembly 10 is in its fully secured position and the tab 38 extends into the opening 58. Note that the tab 38 may include a ramped surface 101 to avoid interference during the insertion of the base 12 within the spring member 14. FIG. 11 illustrates the finger 60 being disposed within the slot 47 formed between the pair of base beams 40 on the upper wall 30 of the base 12 prior to full assembly.

When the base 12 is fully inserted into the spring member 14 and the first and second securing features are engaged, as described above, the arbor 90 may be removed, thereby causing the spring beams 70 to deflect inwardly against the base beams 40. Although the first method of assembly of the electrical terminal 10 does not use any tools, such as the arbor 90, and may be less complicated, the second method of assembly has the advantage of not imparting too much bending force (overstressed force) on the base beams 40 due to the inward deflection against the spring beams 70. Additionally, the width Z of the base beams 40, as shown in FIG. 8, may be made wider than the base beams 40 used in an electrical terminal assembly 10 assembled in the first assembly method. For the first assembly method, the widths Z of the base beams 40 are configured at a dimension enabling the tip portions 48 of the base beams 40 to be pushed toward one another during the inward deflection caused by the spring beams 70 being slipped over the base beams 40. Note that although the curved outwardly configuration of the tip portions 48 of the base beams 40 requires deflection of the base beams 40 when inserting into the spring member 70, removal of the curved tip portions 48 may not be desired. The curved regions at the contact engagement surface 49 at the tip portions 48 provide a relatively good contact engagement with the outer surface of the pin 16 compared to straight formed base beams (not shown) wherein the contact engagement surface is the very edge of the elongated straight beam.

Figure 15:
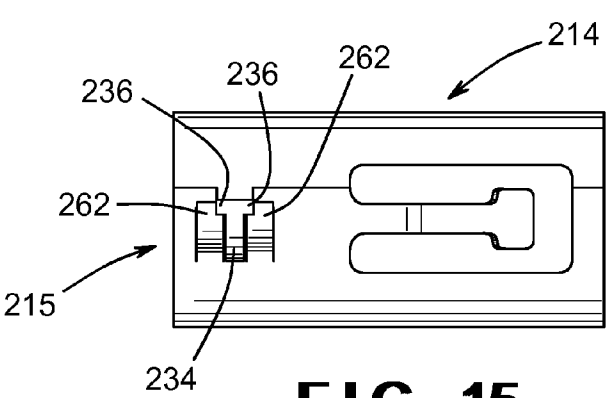
FIG. 15 is a side elevational view of the spring member of FIG. 14.
Figure 14:
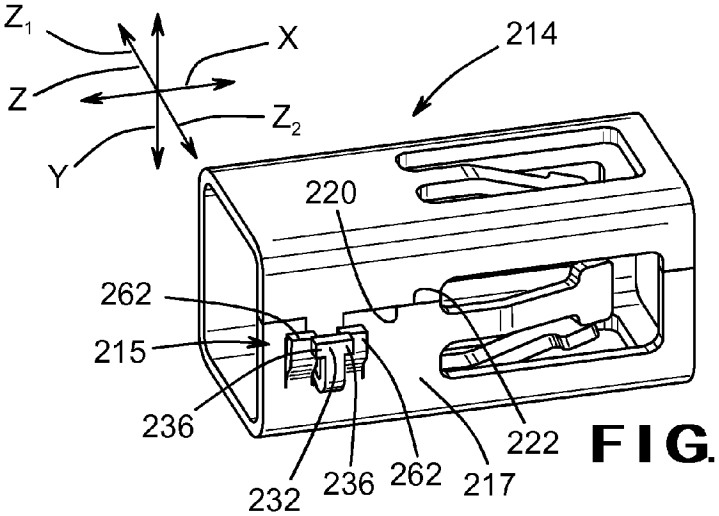
FIG. 14 is a perspective view of a second embodiment of spring member.
Figure 18:
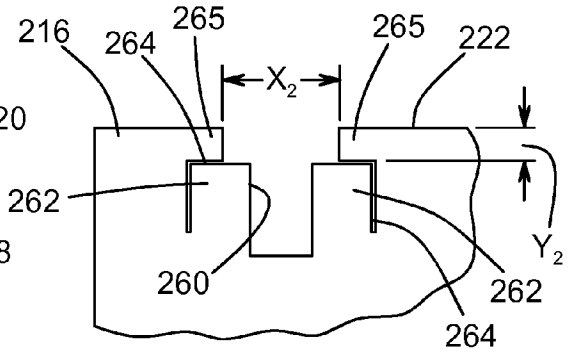
FIG. 18 is a schematic enlarged plan view of a second portion of the blank used to form the interlock feature of the spring member of FIG. 14.
Figure 17:
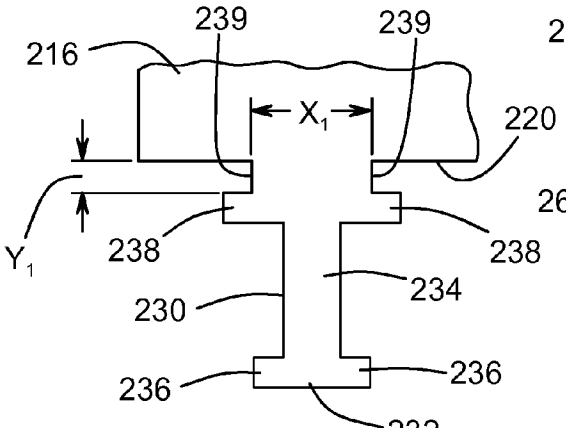
FIG. 17 is a schematic enlarged plan view of a first portion of a blank used to form an interlock feature of the spring member of FIG. 14.
Figure 16:
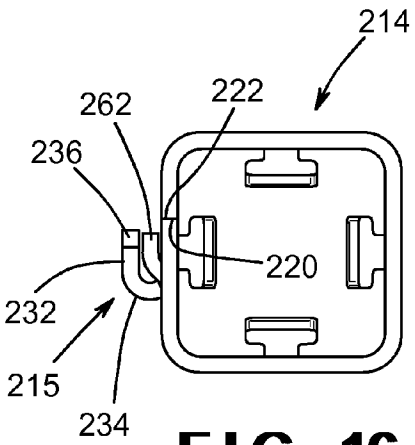
FIG. 16 is an end elevational view of the spring member of FIG. 14.

There is illustrated in FIGS. 14 through 16 a second embodiment of a spring member, indicated generally at 214. The spring member 214 may be used in place of the spring member 14 used in the electrical terminal assembly 10 described above. One of the main differences between the spring member 214 and the spring member 14 is that the spring member 214 includes a different locking feature, indicated generally at 215, compared to the non-overlapping dovetail 61 configuration shown in FIGS. 12 and 13. The locking feature 215 may be integrally formed from a blank that is used to form the spring member 214 and is located in one of the walls 217 of the spring member 215. For example, there is illustrated in FIGS. 17 and 18, portions of a blank 216 which are used to form the spring member 214. FIG. 17 illustrates features formed adjacent a first edge 220 of the blank 216. FIG. 18 illustrates features formed adjacent a second edge 222 of the blank 216. The mating of the corresponding edges 220 and 222 can be seen in the assembled views of FIGS. 14 through 16. As will be explained below, the locking feature 215 helps prevent the first and second edges 220 and 222 from moving apart from one another in all three dimensional coordinate directions, labeled X, Y, and Z ($Z_1$ and $Z_2$) in FIG. 14.

Referring to FIG. 17, a tab 230 extends outwardly from the first edge 220. The end of the tab 230 includes head portion 232 having a width which is larger than a neck portion 234. The head portion 232 defines a pair of extensions 236 extending outwardly from the neck portion 234. The tab 230 also includes a pair of wings 238 extending from the neck portion 234. The wings 238 are spaced from the first edge 220 to define a pair of recesses 239. The recesses 239 are spaced from one another by a distance $x_1$ and have a width $y_1$, as indicated in FIG. 17.

Referring to FIG. 18, a stepped slot or recess 260 is formed in the blank 220 adjacent the second edge 222. The recess 260 has a width $x_2$ adjacent the edge 222 and then narrows to a smaller width preferably having about the same width dimension as the neck portion 234 of the tab 230. A pair of flaps 262 are provided adjacent the recess 260. L-shaped cut-outs 264 can be formed in the blank 216 to define outer sides of the flaps 262. The cut-outs 264 also define a pair of tab portions 265 spaced apart from one another the distance $x_2$.

As shown in FIG. 14, to assembly the locking feature 215, the flaps 262 are bent outwardly in the $Z_2$ direction from the surface of the blank 216 and are positioned over the wings 238 (hidden from view) of the tab 230. Note that in the final assembly of the spring member 214, the wings 238 are flush with the surrounding portions of the blank 216 while the flaps 262 are positioned outwardly therefrom in the $Z_2$ direction. Additionally, the tab portions 265 are positioned within respective recesses 239. The dimensions $x_1$ and $x_2$ are preferably approximately equal to one another. The dimensions $y_1$ and $y_2$ are preferably approximately equal to one another. This configuration traps the tab portions 262 within the respective recesses 239 such that the edges 220 and 222 of the blank 216 are prevented from moving away from each other in the X and Y directions. During the final assembly process, the neck portion 234 of the tab 230 is bent in a U-shaped manner, as shown in FIG. 16, such that the extensions 236 of the head portion 232 are disposed over portions of the flaps 262, as best shown in FIG. 14. Thus, the flaps 262 are captured and disposed between the wings 238 and the extensions 236. This captured arrangement prevents the first edge 220 from separating from the second edge 222 in the Z direction. More specifically, the extensions 236 engaging with the flaps 262 prevent the edge 220 from moving in the $Z_1$ direction relative to the edge 222. The flaps 262 engaging with the wings 238 prevent the edge 220 from moving in the $Z_2$ direction relative to the edge 222. Additionally, the edges 220 and 222 are prevented from being moved relative to one another along the X direction due to the neck portion 234 being disposed in the recess 260. Thus, the locking feature 215 provides a mechanical lock preventing the tab 230 from moving relative to the recess 260 in all three dimensions by physical blocking. Note that the dovetail locking feature provides mechanical locking in two dimensions while utilizing frictional interference engagement to prevent movement in the third dimension.

The principle and mode of operation of this invention have been explained and illustrated in its preferred embodiments. However, it must be understood that this invention may be practiced otherwise than as specifically explained and illustrated without departing from its spirit or scope.

What is claimed is:

1. An electrical terminal assembly comprising:

a base including a box-shaped main portion having four walls that are generally oriented at ninety degrees relative to one another, each of the four walls of the base having a base beam extending therefrom;

a spring member including a box-shaped main portion having four walls that are generally oriented at ninety degrees relative to one another, each of the four walls of the spring member having a spring beam extending therefrom, the box-shaped main portion of the spring member being disposed about the box-shaped main portion of the base such that the spring beams of the spring member urge the base beams of the base toward one another;

first securing features provided on the base and the spring member that cooperate to prevent movement of the base relative to the spring member in a first axial direction; and second securing features provided on the base and the spring member that cooperate to prevent movement of the base relative to the spring member in a second axial direction that is opposite to the first axial direction, wherein either (1) each of the four walls of the base has a plurality of base beams extending therefrom, or (2) each of the four walls of the spring member has a single spring beam extending therefrom.

2. The electrical terminal assembly defined in claim 1 wherein the box-shaped main portion of the base is made from a folded blank having first and second edges that abut one another in a non-overlapping manner.

3. The electrical terminal assembly defined in claim 1 wherein the box-shaped main portion of the spring member is made from a folded blank having first and second edges that abut one another in a non-overlapping manner.

4. The electrical terminal assembly defined in claim 1 wherein both (1) the box-shaped main portion of the base is made from a folded blank having first and second edges that abut one another in a non-overlapping manner, and (2) the box-shaped main portion of the spring member is made from a folded blank having first and second edges that abut one another in a non-overlapping manner.

5. The electrical terminal assembly defined in claim 1 wherein the first securing features provided on the base and the spring member include a tab provided on the base that cooperates with an edge of an opening provided on the spring member.

6. The electrical terminal assembly defined in claim 1 wherein the second securing features provided on the base and the spring member include an edge of an opening provided on the base that cooperates with a finger provided on the spring member.

7. The electrical terminal assembly defined in claim 1 wherein both (1) the first securing features provided on the base and the spring member include a tab provided on the base that cooperates with an edge of an opening provided on the spring member, and (2) the second securing features provided on the base and the spring member include an edge of an opening provided on the base that cooperates with a finger provided on the spring member.

8. The electrical terminal assembly defined in claim 1 wherein each of the four walls of the base has a plurality of base beams extending therefrom, and wherein each of the four walls of the spring member has a single spring beam extending therefrom.

9. The electrical terminal assembly defined in claim 1 wherein each of the four walls of the base has a plurality of base beams extending therefrom.

10. The electrical terminal assembly defined in claim 9 wherein each of the four walls of the spring member has a single spring beam extending therefrom.

11. The electrical terminal assembly defined in claim 1 wherein the box-shaped main portion of the spring member is made from a folded blank having first and second edges that abut one another in an overlapping manner.

12. The electrical terminal assembly defined in claim 11 wherein the first edge has a tab extending therefrom that overlaps a flap extending from the second edge.

13. The electrical terminal assembly defined in claim 11 wherein the first edge has a tab extending therefrom that overlaps each of two flaps extending from the second edge.

14. An electrical terminal assembly comprising:

a base including a box-shaped main portion having four walls that are generally oriented at ninety degrees relative to one another, each of the four walls of the base having a base beam extending therefrom;

a spring member including a box-shaped main portion having four walls that are generally oriented at ninety degrees relative to one another, each of the four walls of the spring member having a spring beam extending therefrom, the box-shaped main portion of the spring member being disposed about the box-shaped main portion of the base such that the spring beams of the spring member urge the base beams of the base toward one another;

a tab provided on the base that cooperates with an edge of an opening provided on the spring member to prevent movement of the base relative to the spring member in a first axial direction; and an edge of an opening provided on the base that cooperates with a finger provided on the spring member to prevent movement of the base relative to the spring member in a second axial direction that is opposite to the first axial direction.

15. The electrical terminal assembly defined in claim 14 wherein the box-shaped main portion of the base is made from a folded blank having first and second edges that abut one another in a non-overlapping manner.

16. The electrical terminal assembly defined in claim 14 wherein the box-shaped main portion of the spring member is made from a folded blank having first and second edges that abut one another in a non-overlapping manner.

17. The electrical terminal assembly defined in claim 14 wherein both (1) the box-shaped main portion of the base is made from a folded blank having first and second edges that abut one another in a non-overlapping manner, and (2) the box-shaped main portion of the spring member is made from a folded blank having first and second edges that abut one another in a non-overlapping manner.

18. The electrical terminal assembly defined in claim 14 wherein the box-shaped main portion of the spring member is made from a folded blank having first and second edges that abut one another in an overlapping manner.

19. The electrical terminal assembly defined in claim 14 wherein the first edge has a tab extending therefrom that overlaps a flap extending from the second edge.

20. The electrical terminal assembly defined in claim 14 wherein the first edge has a tab extending therefrom that overlaps each of two flaps extending from the second edge.

* * * * *